United States Patent [19]

Bliznik et al.

[11] Patent Number: 4,686,065

[45] Date of Patent: Aug. 11, 1987

[54] CAUSTIC BASED CLEANING COMPOSITION CONTAINING THFA AND A PROPOXYLATED ALCOHOL OR PHENOL

[75] Inventors: Kenneth E. Bliznik, Dolton; Gilles M. L. Verboom, Decatur, both of Ill.

[73] Assignee: Miles Laboratories, Inc., Elkhart, Ind.

[21] Appl. No.: 866,306

[22] Filed: May 23, 1986

[51] Int. Cl.[4] ..... C11D 7/06; C11D 7/26; C11D 7/50; C11D 7/52

[52] U.S. Cl. ..... 252/159; 134/40; 252/158; 252/160; 252/170; 252/174.25

[58] Field of Search ..... 252/153, 154, 158, 159, 252/160, 162, 170, 173, 174.25, DIG. 14; 134/40

[56] References Cited

U.S. PATENT DOCUMENTS

| | | | |
|---|---|---|---|
| 3,335,092 | 8/1967 | Perry | 252/158 |
| 3,829,387 | 8/1974 | Wise | 252/156 |
| 3,847,839 | 11/1974 | Murphy | 252/544 |
| 3,882,038 | 5/1975 | Clayton | 252/164 |
| 4,366,002 | 12/1982 | Carandang | 134/2 |
| 4,477,288 | 10/1984 | Kazmierczak | 134/19 |
| 4,477,365 | 10/1984 | Verboom | 252/156 |
| 4,537,705 | 8/1985 | Mahoney | 252/529 |
| 4,600,522 | 7/1986 | Grzeskowiak | 252/170 |

*Primary Examiner*—Dennis L. Albrecht
*Attorney, Agent, or Firm*—Jerome L. Jeffers

[57] ABSTRACT

Disclosed is a cleaning composition for removing baked on soils from hard surfaces. The composition comprises an alkali metal hydroxide, and a solvent system made up of tetrahydrofurfuryl alcohol together with a propoxylated alcohol or phenol and a thickener to provide a composition having a suitable viscosity for its intended use.

9 Claims, No Drawings

CAUSTIC BASED CLEANING COMPOSITION CONTAINING THFA AND A PROPOXYLATED ALCOHOL OR PHENOL

BACKGROUND OF THE INVENTION

The present invention involves a novel composition for use in removing cooking deposits from surfaces, particularly ovens, soiled with such deposits.

Among the most distasteful of necessary household tasks is that of cleaning an oven. Because of the deposit of grease, both fresh and baked-on and hard baked-on food spills, the job of cleaning an oven becomes all but impossible. It is necessary, however, to regularly clean an oven in order to prevent the buildup of deposits which will prevent even heat distribution and mar its appearance. In recent times several types of products have appeared on the market to aid in cleaning dirty ovens.

In U.S. Pat. No. 3,829,387 there is disclosed a composition for cleaning ovens which comprises:

(1) from about 2 to 6% of a caustic material;

(2) from about 55 to 93% water;

(3) a solvent mixture of from about 55 to 90% of $X—\phi—(OCH_2CH_2)_n—OH$ and about 45 to 10% of $X—\phi—(OCH_2—CH_2)_p—OH$ where X is hydrogen or lower alkyl, n is 1 to 3 and p is n−1;

(4) from 0 to 15% of an organic solvent; and (5) at least abut 0.2% of a water soluble, alkali stable thickener.

U.S. Pat. No. 3,335,092 discloses a composition for cleaning ovens and other surfaces having burnt-on deposits of soil, which composition comprises water and an alkali metal hydroxide in an aerosol container containing a propellant. In a preferred embodiment this formulation also contains a polyhydric alcohol as humectant, an anionic, cationic or nonionic surfactant and a "catalyst" selected from the group of furfuryl alcohol, hydrofurfuryl alcohol or a mixture thereof.

U.S. Pat. No. 4,157,921 discloses a formulation for cleaning ovens which is a water based thixotropic composition and contains from 1 to 7% of an alkali, a first thickener, a surfactant, a humectant, an organic solvent and a second thickener comprising a thixotropic emulsion of a copolymer of acrylic acid and ethylene.

SUMMARY OF THE INVENTION

The present invention is a composition for removing cooking deposits from surfaces soiled with such deposits which comprises on a weight/weight basis as a percentage of the entire composition:

(a) from 7 to 10 percent of an alkali metal hydroxide;

(b) a solvent system for the alkali metal hydroxide which comprises:

i. from 2 to 20 percent of tetrahydrofurfuryl alcohol; and ii. from 1 to 10 percent of one or more propoxylated alcohols or phenols of the formula:

$$R—O—CH_2CH(CH_3)O—_nH$$

wherein R is phenyl or a straight chain alkyl of 1 to 4 carbon atoms and n is 1–3 in which the weight ratio of tetrahydrofurfuryl alcohol to propoxylated alcohol is about 2:1, (c) an alkali compatible thickener which, when present in adequate quantity, will cause the composition to have a resting viscosity of from about 1,000 to about 5,000 centipoise at room temperature, said composition being further defined in that the weight ratio of alkali metal hydroxide to the solvent system is about 1:2, and (d) the balance is water.

DESCRIPTION OF THE INVENTION

The caustic cleaning composition described and claimed herein is a highly effective cleaner which, when used to clean a soiled oven, clings to the vertical and upper walls very satisfactorily, thus enhancing intimate contact between the cleaner and soil on all surfaces. The composition is especially effective as an oven cleaner because it causes the removal of difficult baked on grease and fat from the oven without the use of heat and in a short time.

Suitable alkali metal hydroxides include sodium, potassium and lithium hydroxide with the sodium species being preferred. If desired, a mixture of these alkali metal hydroxides can be used.

While the composition is essentially an aqueous system, there is included a solvent system which causes it to exhibit extremely effective removal of baked on grease from ovens. This solvent system contains from 2 to 20% tetrahydrofurfuryl alcohol (THFA), and from 1 to 10% of a propoxylated alcohol or phenol of the formula:

$$R—O—CH_2CH(CH_3)O—_nH$$

wherein n is 1 to 3. In the above formula, R can be phenyl or a straight chain alkyl of 1 to 4 carbon atoms; a propoxylated alcohol in which R is methyl is preferred. It is also preferred that the solvent system will comprise from 10 to 16% THFA and from 5 to 8% of the propoxylated alcohol and that this solvent system make up from 8 to 20 weight percent of the composition. The weight ratio of tetrahydrofurfuryl alcohol to the propoxylated alcohol should be about 2:1. This ratio is necessary in order to provide a 1 phase solvent system compatible with water and caustic which provides optimal cleaning performance. When the solvent system is employed in a ratio varying more than about ten percent from 2 parts tetrahydrofurfuryl alcohol to 1 part propoxylated alcohol, phase separation occurs which significantly detracts from the composition's cleaning performance. The use of a solvent system as described above results in a caustic cleaning composition which is as effective a cleaner as that which employs 12% tetrahydrofurfuryl alcohol and 6% furfuryl alcohol as the solvent system and provides several advantages thereover due to the elimination of furfuryl alcohol. Thus, there is very little odor produced by the solvent system of the present invention, and there is no need for surfactants or hydrotropes since the solvent system forms a stable, one phase system with the alkali metal hydroxide. Furthermore, there is no need for humectants since the propoxylated methyl ether-THFA combination is relatively slow drying yet quite penetrating to the soil. This feature also results in easier cleaning and removal of soil. In addition, the present composition is quite efficacious at room temperature thereby obviating the need for preheating the surface to be cleaned. Finally, the present system is to be preferred over that containing furfuryl alcohol because this solvent is somewhat toxic as reported in Dangerous Properties of Materials, Sax. Sixth Edition, Van Nostrand and Reinhold.

It has been discovered that the ratio of the solvent system to the alkali is important for optimal cleaning effectiveness. Thus, a ratio of 2:1 within tolerance limits of about ten percent either way is required. The cleaning effectiveness of the formulation having a ratio of solvent to alkali outside this range deteriorates rapidly.

In addition to the solvent system, it is essential that the composition contain a thickener. In the broadest sense, the thickener should increase the resting viscosity of the composition to a level of from about 1,000 to 5,000 cps at room temperature. When the composition is to be applied by use of a cleaning pad such as that described in U.S. Pat. No. 4,475,835, the thickener should be employed in an amount sufficient to increase the resting viscosity to a level of from about 2500 to 3600 centipoise at room temperature as measured by a Brookfield RVT viscometer. Any alkali compatible thickener such as attapulgite clay, colloidal magnesium aluminum silicate, acrylic acid copolymers or a combination thereof may be used; Veegum T, a colloidal magnesium aluminum silicate, is preferred.

Optionally, a pigment may be added to the composition to provide opacity thereby adding visibility to the product during use. Any pigment which will provide the desired opacity and is not detrimentally reactive with the other ingredients is satisfactory; titanium dioxide is preferred at a level of up to about 3%. The rutile crystalline structure is particularly preferred because of its greater opacifying power in comparison to the anatase structure.

The present invention is further illustrated by the following example.

EXAMPLE I

To a 50 gallon mixing tank equipped with a lightning mixer was added 32.4 kg of a 4% Veegum T slurry and 31.2 kg of deionized water which were mixed until homogeneous.

In a side container there was prepared a solvent blend of 12 kg of THFA, 5.86 kg of Dowanol DPM, a dipropylene glycol methyl ether corresponding to the foregoing formula where R is methyl and n is 2, and 0.14 kg of Dowanol PPh, a propylene glycol phenyl ether corresponding to the foregoing formula where R is phenyl and n is 1 which is optionally employed to add extra solvency to the system by nature of its lipophilic characteristics. Hexyl carbitol and ethylene glycol ethers have been found to be suitable as auxiliary solvents. The use of an auxiliary solvent is especially desirable when the amount of the primary solvent system is below the preferred range.

With continuous stirring the solvent blend was added to the 50 gallon tank holding the Veegum T slurry prepared as described above. At this point there was added 0.5 kg of titanium dioxide whereupon the mixture was stirred until homogeneously white.

Ten other formulations were prepared using the general procedure described above. These compositions have been prepared with propoxylated alcohols such as Dowanol DPM, PM, TPM and PPh manufactured by the Dow Chemical Company. The eleven formulations and their cleaning performances are set out in Table 1. The optional addition of ethoxylated alcohols to the formulation is illustrated by IV and V with ethylene glycol phenyl ether and hexyl carbitol.

Performance was determined using the CSMA Standard Test Procedure for Evaluating the Efficacy of Oven Cleaners except that it was modified by using test soils that were mixtures of chicken, beef and pork grease baked on procelain oven tiles for 3 hours at 450° F. This modification resulted in a more rigorous test than does the unmodified CSMA procedure. The cleaning performance was rated on a scale of 1 to 10 with a rating of 10 indicating complete soil removal and a rating of 1 indicating no soil removal. Ratings between 1 and 10 are proportionate to the amount of soil removed.

TABLE 1

| | I | II | III | IV | V | VI | VII | VIII | IX | X | XI |
|---|---|---|---|---|---|---|---|---|---|---|---|
| (50%) Sodium Hydroxide | 18.0 | 18.0 | 18.0 | 18.0 | 18.0 | 18.0 | 18.0 | 18.0 | 18.0 | 18.0 | 18.0 |
| THFA | 12.0 | 12.0 | 12.0 | 12.0 | 12.0 | 11.3 | 10.0 | 9.3 | 12.0 | 12.0 | 18.0 |
| Furfuryl Alcohol | — | — | — | — | — | — | — | — | — | 6.0 | — |
| Dowanol DPM | 5.86 | 2.9 | 5.5 | 4.0 | 4.5 | 5.5 | 4.9 | 4.8 | — | — | — |
| Dowanol PPh | 0.14 | 0.19 | — | — | — | 0.13 | 0.12 | 0.11 | 0.14 | — | — |
| Dowanol PM* | — | 2.9 | — | — | — | — | — | — | 2.96 | — | — |
| Dowanol TPM | — | — | 0.5 | — | — | — | — | — | 2.9 | — | — |
| Dowanol EPh** | — | — | — | 2.0 | — | — | — | — | — | — | — |
| Hexyl Carbitol*** | — | — | — | — | 1.5 | — | — | — | — | — | — |
| Veegum T | 1.3 | 1.3 | 1.3 | 1.3 | 1.3 | 1.3 | 1.3 | 1.3 | 1.3 | 1.3 | 1.3 |
| TiO2 | 0.5 | 0.5 | 0.5 | 0.5 | 0.5 | 0.5 | 0.5 | 0.5 | 0.5 | 0.5 | 0.5 |
| Water | | | | | | q. s. 100% | | | | | |
| PERFORMANCE | 10 | 8 | 8 | 9 | 9 | 8 | 10 | 8 | 7–8 | 10 | 5 |

*Propylene glycol methyl ether
**Ethylene glycol phenyl ether
***Diethylene glycol hexyl ether Referring to Table 1, the preferred composition (I) and composition VII perform as well as composition X which employs a THFA/furfuryl alcohol solvent mixture. This is a prior art composition generally available and known to be very effective for removing soils. Composition XI which contains an enhanced amount of THFA but no cosolvent was the poorest performer with only 50% soil removal being observed.

These formulations are stable. Formulations III-VIII and the preferred one stay homogeneous after two weeks in a 120° F. temperature environment. When brought back to room temperature, they were found to perform as well as the controls which were kept at room temperature.

The cleaning composition of the present invention is suitable for use in aerosol or pump spray dispensers. It is particularly suitable for use in the oven cleaning device disclosed in U.S. Pat. No. 4,475,835. When used in this device, the preferred viscosity range is 2500 to 3600 centipoise at room temperature. In this range, the composition is easily applied with the device's scrubber pad and it clings to the vertical walls of the oven in sufficient quantities to perform its intended function. This viscosity range is also preferred for application with a sponge. For a pump spray, the preferred viscosity would be within the range of from 1500 to 2,000 centipoise. In general, the viscosity can be as low as 1,000 or as high as 5,000 cps depending on the application means selected. In all cases the viscosity is measured when the formulation is at rest. Since this is a somewhat thixotropic formulation, it should be shaken before use. When applying the cleaning composition with a sponge or scrubber, an increase in viscosity above about 3600 centipoise results in a tacky material so that greater quantities (more than is really needed) are required just to cover the soiled surface. As the viscosity decreases below about 2500, the tendency to run (flow) down the vertical walls of the oven becomes more pronounced, resulting in a waste of product. However, a lower viscosity can be tolerated when a pump spray dispenser is used because the delivery rate per squeeze is such that the foregoing problems can be avoided unless the same area is repetitively covered with the fluid.

What is claimed is:

1. A composition for removing cooking deposits from surfaces soiled with such deposits which comprises on a weight/weight basis as a percentage of the entire composition:

(a) from 7 to 10 percent of an alkali metal hydroxide;

(b) a solvent system for the alkali metal hydroxide which comprises:

i. from 2 to 20 percent of tetrahydrofurfuryl alcohol, and ii. from 1 to 10 percent of one or more propoxylated alcohols or phenols of the formula:

$$R—O—CH_2CH(CH_3)O—_nH$$

wherein R is phenyl or a straight chain alkyl of 1 to 4 carbon atoms and n is 1-3 in which the weight ratio of tetrahydrofurfuryl alcohol to propoxylated alcohol is about 2:1, (c) an alkali compatible thickener which when present in adequate quantity, will cause the composition to have a resting viscosity of from about 1,000 to about 5,000 centipoise at room temperature, said composition being further defined in that the weight ratio of alkali metal hydroxide to the solvent system is about 1:2, and (d) the balance is water.

2. The composition of claim 1 wherein the viscosity is from about 2500 to 3600 centipoise.

3. The composition of claim 1 wherein the thickener is colloidal magnesium aluminum silicate.

4. The composition of claim 1 which contains an opacifying pigment.

5. The composition of claim 1 wherein the propoxylated alcohol is dipropylene glycol methyl ether.

6. The composition of claim 1 wherein the solvent system comprises from 10 to 16 percent tetrahydrofurfuryl alcohol and from 5 to 8% of the propoxylated alcohol and wherein the composition is substantially free of furfuryl alcohol.

7. A caustic based cleaning composition for removing baked on soil from oven surfaces which comprises on a weight/weight basis as a percentage of the entire composition:

(a) from 7 to 10 percent of sodium hydroxide;

(b) from 8 to 20 percent of a solvent system for the alkali metal hydroxide which comprises:

i. from 10 to 16 percent of tetrahydrofurfuryl alcohol (THFA,) and ii. from 5 to 8 percent propylene glycol methyl ether wherein the weight ratios of THFA to propylene glycol methyl ether and solvent system to sodium hydroxide about 2:1, and (c) a sodium hydroxide compatible thickener in sufficient amount to cause the composition to have a resting viscosity of from about 1,000 to 5,000 centipoise at room temperature.

8. The composition of claim 7 wherein the thickener is colloidal magnesium aluminum silicate.

9. The composition of claim 8 wherein the viscosity is from about 2,500 to 3,600.

* * * * *

UNITED STATES PATENT AND TRADEMARK OFFICE

CERTIFICATE OF CORRECTION

PATENT NO. : 4,686,065

DATED : August 11, 1987

INVENTOR(S) : Kenneth E. Bliznik, Gilles M. L. Verboom

It is certified that error appears in the above-identified patent and that said Letters Patent is hereby corrected as shown below:

Column 1, line 61 - Change $R\text{-}O\text{-}CH_2CH(CH_3)O\text{-}_nH$ to $R\text{-}O\{CH_2CH(CH_3)O\}_nH$ Column 2, line 30 - Change $R\text{-}O\text{-}CH_2CH(CH_3)O\text{-}_nH$ to $R\text{-}O\{CH_2CH(CH_3)O\}_nH$ Column 5, line 36 - Change $R\text{-}O\text{-}CH_2CH(CH_3)O\text{-}_nH$ to $R\text{-}O\{CH_2CH(CH_3)O\}_nH$ Column 6, line 34 - Insert "are" after ---hydroxide---.

Signed and Sealed this

First Day of December, 1987

*Attest:*

*Attesting Officer*

DONALD J. QUIGG

*Commissioner of Patents and Trademarks*